US005985379A

United States Patent [19]

Longsdorf et al.

[11] Patent Number: 5,985,379

[45] Date of Patent: Nov. 16, 1999

[54] DECORATIVE DISPLAY PLATE

[75] Inventors: Ronald Warren Longsdorf, West Chester, Pa.; Richard Dale Bankert, Wilmington, Del.

[73] Assignee: Franklin Mint Company, Franklin Center, Pa.

[21] Appl. No.: 08/898,414

[22] Filed: Jul. 22, 1997

[51] Int. Cl.[6] ..... G09F 19/00

[52] U.S. Cl. ..... 428/13; 428/66.5; 40/410; 446/267

[58] Field of Search ..... 428/13, 68, 76, 428/66.5; 446/267; 40/410, 406

[56] References Cited

U.S. PATENT DOCUMENTS

| | | | |
|---|---|---|---|
| D. 11,936 | 8/1880 | Davis | D11/132 |
| D. 13,973 | 6/1883 | Brownell | D11/132 |
| D. 15,881 | 3/1885 | Brownell | D11/132 |
| D. 17,065 | 1/1887 | Pfitzner | D11/140 |
| D. 21,150 | 11/1891 | Vandenburgh | D11/140 |
| D. 43,306 | 12/1912 | Greenburg | D11/132 |
| D. 53,002 | 2/1919 | Dahl | D11/132 |
| D. 78,028 | 3/1929 | Hurley | D11/132 |
| D. 85,168 | 9/1931 | Cutler | D11/132 |
| D. 98,049 | 1/1936 | Blow | D11/132 |
| D. 132,693 | 6/1942 | Webb, Jr. | D11/132 |
| D. 132,980 | 7/1942 | Robbins | D80/9 |
| D. 158,699 | 5/1950 | Wasilevich | D9/239 |
| D. 215,204 | 9/1969 | Rimm | D29/23 |
| D. 220,342 | 3/1971 | Anderson | D29/23 |
| D. 221,234 | 7/1971 | Anderson | D29/23 A |
| D. 234,433 | 3/1975 | Zivica | D11/133 |
| D. 246,839 | 1/1978 | Campbell | D11/137 |
| D. 246,842 | 1/1978 | Campbell | D11/135 |
| D. 247,229 | 2/1978 | Campbell | D11/133 |
| D. 248,743 | 8/1978 | Campbell | D11/133 |
| D. 253,814 | 1/1980 | Hill | D11/132 |
| D. 257,266 | 10/1980 | Curry et al. | D19/97 |
| 258,821 | 5/1882 | Storck | 428/900 |
| D. 264,452 | 5/1982 | Crawford | D11/139 |
| D. 266,749 | 11/1982 | Sun | D11/121 |
| D. 274,799 | 7/1984 | Guest et al. | D11/132 |
| D. 276,961 | 1/1985 | Kemper | D6/466 |
| D. 289,269 | 4/1987 | Fleckenstein | D11/157 |
| D. 290,447 | 6/1987 | Evans | D11/131 |
| D. 318,605 | 7/1991 | Dudley | D11/117 |
| D. 322,540 | 12/1991 | Levinson | D7/579 |
| D. 326,873 | 6/1992 | Chang | D21/87 |
| D. 346,761 | 5/1994 | Milam | D11/132 |
| D. 364,111 | 11/1995 | Smolik | D11/132 |
| D. 367,560 | 3/1996 | Kwan | D6/310 |
| D. 375,411 | 11/1996 | Hawkins | D6/314 |
| 598,080 | 2/1898 | Fish | 428/34.1 |
| 660,782 | 10/1900 | Strompell | 428/14 |
| 783,170 | 2/1905 | Beach | 34/1 |
| 897,668 | 9/1908 | Shoemaker | 34/2 |
| 1,253,803 | 1/1918 | Felsenthal | 40/152 |
| 1,270,370 | 6/1918 | Boning | 40/152 |
| 1,272,484 | 7/1918 | McLaughlin | 40/152 |
| 1,853,902 | 4/1932 | Kaplan | 40/152 |
| 2,183,426 | 12/1939 | Hart | 40/160 |
| 2,361,423 | 10/1944 | Snyder | 41/10 |

(List continued on next page.)

FOREIGN PATENT DOCUMENTS

| | | |
|---|---|---|
| 42400 | 7/1977 | Canada . |
| 1335474 | 5/1995 | Canada . |
| 1155046 | 4/1958 | France . |
| 1204801 | 1/1960 | France . |

*Primary Examiner*—Alexander Thomas
*Attorney, Agent, or Firm*—Seidel Gonda, Lavorgna & Monaco, PC

[57] ABSTRACT

A decorative display article is provided having a plate and a transparent vessel mounted thereon. The vessel defines a reservoir for retaining a liquid and a particulate material which will fall gently through the liquid upon agitation. The reservoir is mounted within the central portion of the plate and a peripheral rim on the plate extends radially outwardly therefrom. A sculpture is positioned within the reservoir and fixed proximal to the plate. Decorative artwork may be provided on the plate and/or as part of the vessel.

10 Claims, 6 Drawing Sheets

U.S. PATENT DOCUMENTS

| | | | |
|---|---|---|---|
| 2,587,620 | 3/1952 | Hormann | 40/33 |
| 2,785,490 | 3/1957 | Fabry | 40/156 |
| 3,692,382 | 9/1972 | Cloutier | 350/5 |
| 3,715,823 | 2/1973 | Brossard | 40/152 |
| 3,740,016 | 6/1973 | Buescher | 248/488 |
| 3,818,623 | 6/1974 | Wilton et al. | 40/324 |
| 3,822,494 | 7/1974 | Zivica | 40/154 |
| 3,949,506 | 4/1976 | Benkowski | 40/160 |
| 4,014,122 | 3/1977 | Woods | 40/358 |
| 4,205,481 | 6/1980 | Tomson | 46/6 |
| 4,275,518 | 6/1981 | Martin | 40/324 |
| 4,521,982 | 6/1985 | Altuchow | 40/407 |
| 4,771,902 | 9/1988 | Teng | 215/1 R |
| 4,807,377 | 2/1989 | Stuckel | 40/125.1 |
| 4,817,311 | 4/1989 | Ong | 40/410 |
| 4,852,283 | 8/1989 | Teng | 40/426 |
| 4,961,276 | 10/1990 | Lin | 40/410 |
| 5,047,267 | 9/1991 | Pantaleo et al. | 428/13 |
| 5,057,344 | 10/1991 | Mealey | 428/13 |
| 5,104,699 | 4/1992 | Pantaleo et al. | 428/13 |
| 5,105,940 | 4/1992 | Chen | 206/217 |
| 5,187,889 | 2/1993 | Kraselsky et al. | 40/407 |
| 5,256,457 | 10/1993 | Pantaleo et al. | 428/13 |
| 5,258,209 | 11/1993 | Bankert et al. | 428/11 |
| 5,261,848 | 11/1993 | Kaplan et al. | 446/74 |
| 5,272,604 | 12/1993 | Lin | 362/96 |
| 5,301,444 | 4/1994 | Horiuchi | 40/426 |
| 5,406,728 | 4/1995 | Willitts, Jr. | 40/409 |
| 5,548,912 | 8/1996 | Liu | 40/410 |

DECORATIVE DISPLAY PLATE

FIELD OF THE INVENTION

The present invention relates to a decorative article in the form of a plate having a central display thereon. The present invention further relates to a transparent display having a liquid and a particulate material therein; the particulate (sometimes referred to as "snow") settling, within the liquid at a relatively slow rate after disturbance.

BACKGROUND OF THE INVENTION

A number of decorative display type devices are known in the art. Such known displays include a domed member for retaining articles such as flowers, taxidermy, minerals or the like. Examples of such displays are found in U.S. Pat. Nos. 660,782 to Strumpell; 2,580,821 to Storck; Des. 264,452 to Crawford; Des. 215,204 to Rimm; and 5,057,344 to Mealey. It is also known to include a liquid and particulate materials within a transparent vessel, such that upon agitation of the liquid the particulate will settle softly over a period of time. Such elements are sometime called "snow globes". The combination of particles and liquid with in a vessel for decorative or entertainment purposes has also been incorporated into display such as placemats or the like. Examples of these type articles are found in U.S. Pat. No. 2,183,426 to Hart and U.S. Pat. Nos. 5,047,267; 5,104,699; and 5,256,457 each to Pantaleo et. al. It is also known to motorize snow globe displays for continuous agitation of the liquid and particles, such as those shown in U.S. Pat. Nos. 2,587,620 to Hormann and 5,301,444 to Horiuchi.

BRIEF DESCRIPTION OF THE INVENTION

The present invention relates to a decorative article comprising a plate and a transparent vessel mounted within the central portion of the plate. The vessel retains a liquid therein as well as a particulate material. A sculpture may also be positioned within the vessel and fixed in position proximal to the surface of the plate.

In a preferred embodiment of the present invention, the plate has a planer central portion and a surrounding peripheral rim which is at an acute angle with the central portion. The transparent vessel is mounted within the central portion of the plate and projects from one side of the plate in the same direction as the peripheral rim. The vessel preferably has a curved upper surface. The sculpture mounted within the rear of the vessel preferably appears to float within the liquid and settling particulate.

A plug may be removably mounted within an opening in the rear wall of the vessel, providing access for filling liquid and/or particulate. The rear wall of the dome may be a separate element from the central portion of the plate or may be positioned within an opening in the central portion of the plate.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
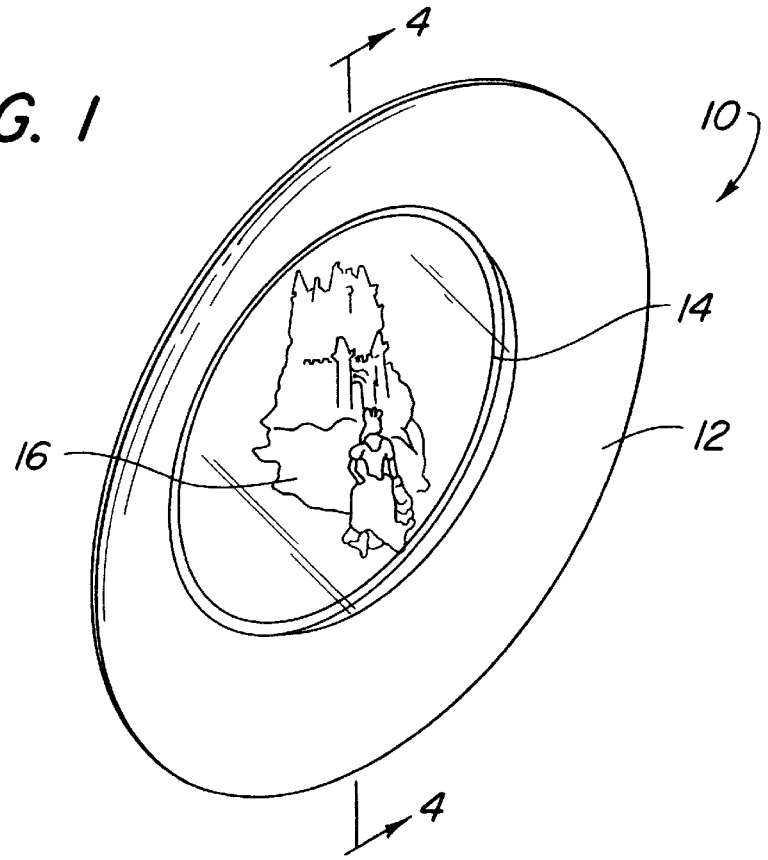
FIG. 1 is a perspective view of a decorative article in accordance with the present invention.
Figure 2:
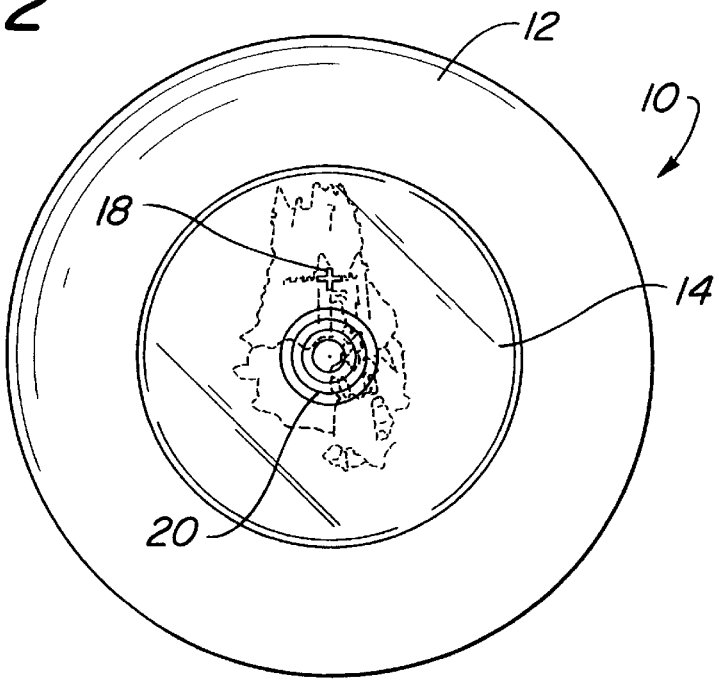
FIG. 2 is a front elevation of the decorative article of the present invention showing a portion of the elements in phantom.

In the drawings, where like numerals indicate like elements, there is shown various embodiments of the decorative display as contemplated by the present invention. In FIGS. 1–4, there is shown an embodiment of a decorative display article which is generally referred to by the numeral 10. The decorative display 10 includes a plate 12 and a dome shaped vessel 14. The vessel 14 is positioned within the central portion of the plate 12 and projects outwardly from the front surface thereof. Positioned within the reservoir defined by the vessel 14 is a sculpture 16. In the figures herein, the sculpture appears to be the outline of a castle having a lady standing in front thereof. As depicted by FIG. 2, the sculpture is mounted on a projection 18 within the rear of the reservoir 14. In addition, a plug 20 is provided within an opening in the rear of the vessel 14 for filling the reservoir with liquid and a particulate material.

Figure 3:
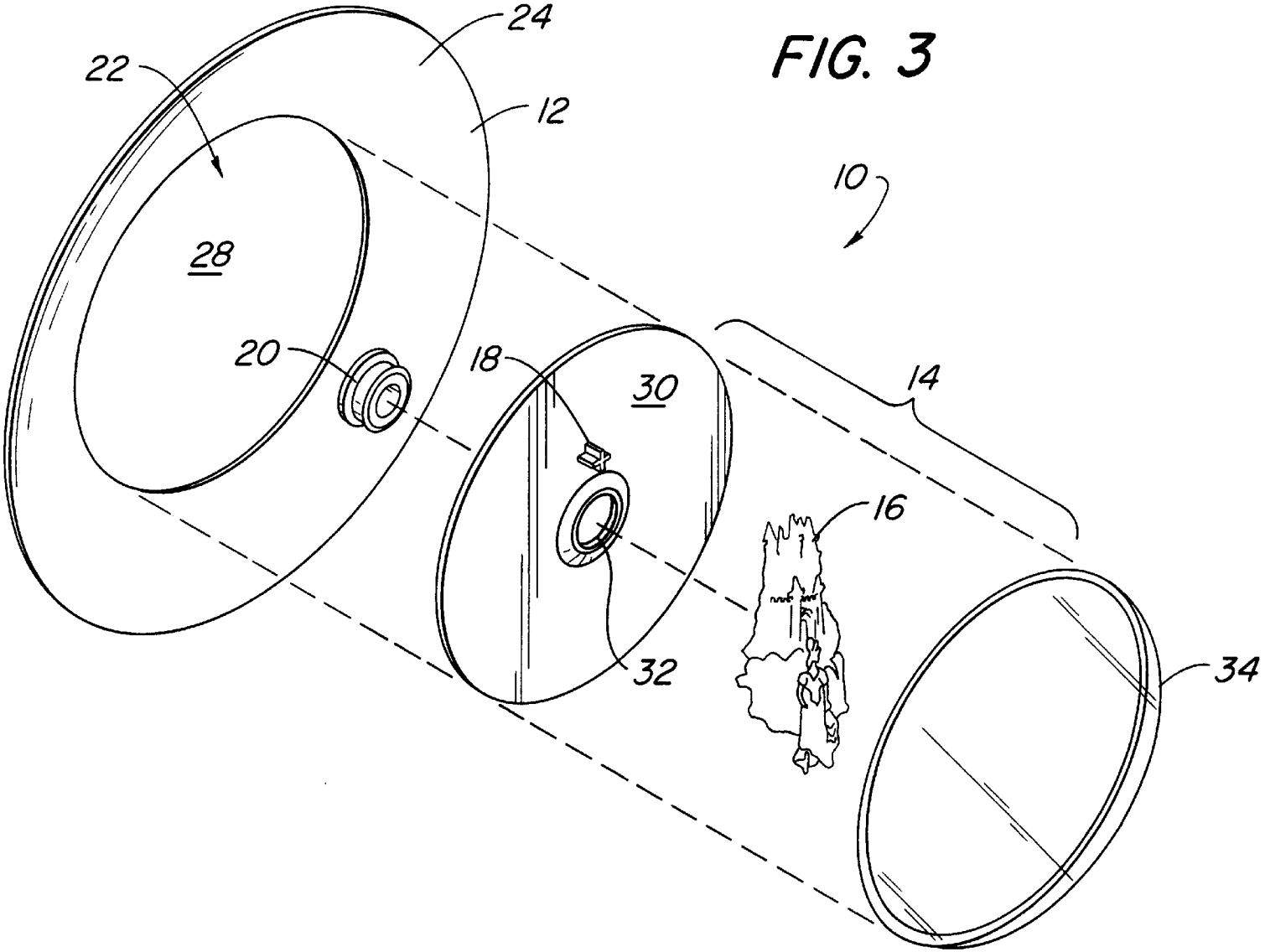
FIG. 3 is a exploded view of the elements of the decorative display of FIGS. 1 and 2.
Figure 4:
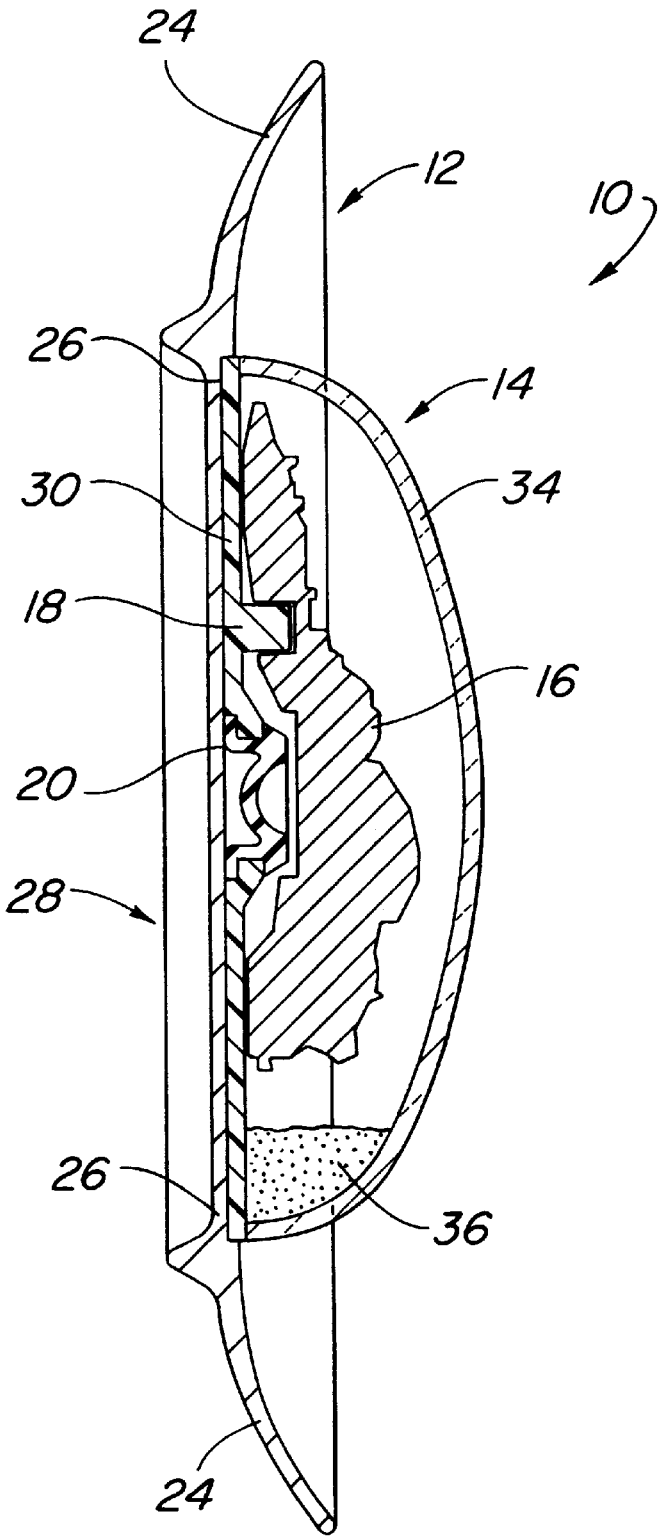
FIG. 4 is a cross sectional view of the decorative display as taken along line 4—4 in FIG. 1.

In FIGS. 3 and 4, the assembly of the decorative display and as more particularly illustrated. The plate 12 comprises a central plainer portion 22 and an annular or surrounding peripheral rim 24. The rim 24 extends radially outwardly from the central portion. The central portion 22 generally comprises a circular lip 26 which defines an flat surface 28 there between. The vessel 14 comprises back wall 30 having the projection 18 mounted on one surface thereof. A central opening 32 is provided within the back wall 30 for receipt of the plug 20. As illustrated, the plug is contoured so as to engage the front and rear surface of the back wall 30. The peripheral surfaces of the central opening 32 may also be contoured to assist in engagement between the plug 20 and the back wall 30 for sealing the reservoir. The front of the vessel 14 comprises a curved lid 34 which is sealed to the peripheral edge of the rear wall 30 to define the sealed reservoir. The sculpture 16 is mounted within the vessel 14. The reservoir may be filled with water and particulate material 36 such that, upon agitation, the particulate material will slowly settle to the bottom creating a snow fall or similar effect.

As can be seen in cross section in FIG. 4, the sculpture 16 includes a rear surface which is adapted to engage the mounting projection 18 on the rear wall 30 of the vessel 14. Clearance is provided between the sculpture 16 and the central opening 32 and plug 20 within the back wall 30 of the vessel 14. Access is provided to the plug by removal of the vessel from the flat surface 28 of the central portion 22 of the plate 12.

The plate 12 is contemplated to be made of porcelain or a similar material and have a decorative artwork provided on (at least) the front surface thereof. The rim 24 of the plate 12 as illustrated is curved and projects outwardly and upwardly to define a central well in the front surface of the plate. The vessel 14 is positioned within the cell of the plate 12 and the curved lid 34 projects outwardly in the same direction as the rim 24. The curved rim 24 is generally at an acute angle with the plain of the central portion 22 of the plate 12.

The vessel is preferably made of a transparent polystyrene material, although other materials are Contemplated and may be utilized. The joint between the curved lid 34 and the rear wall 30 may be made by an ultrasonics, heat welding and/or any suitable adhesive. The joint between the two portions of the reservoir 14 must be sufficient to retain liquid therein, such that the joint does not degrade upon continuous exposure to the liquid.

The particulate material is contemplated to simulated snow and/or glitter and may be any light weight granulated particles which have a specific gravity which is slightly heavier than the liquid. The "snow" preferably has a specific gravity close to water so that it will settle slowly upon agitation of the plate and the water within the vessel.

Another form of the invention may include a central portion of the plate having a central opening. The vessel in this embodiment would be positioned over the opening. The liquid or particulate material could then be replaceable or be refilled within the vessel through the opening in the rear wall of the vessel without removal of the vessel from the plate. In this alternate embodiment the rear wall of the vessel would preferably include background art work that complimented or matched that on the rim of the plate. In the embodiment in FIGS. 1–4, the plate may include artwork and the rear wall may be transparent.

Figure 5:
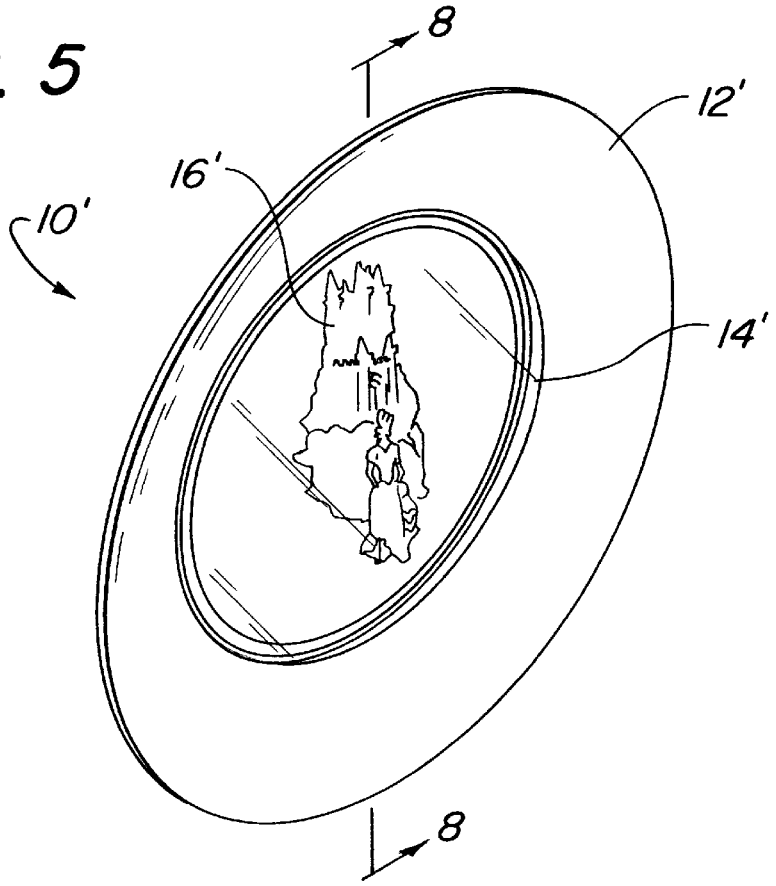
FIG. 5 is a perspective view of an alternate embodiment of the decorative display of the present invention.

In a still further embodiment of the invention, reference should be made to FIGS. 5–8. In FIG. 5, the decorative display 10' includes a modified plate 12' and a variation of the vessel 14'. A sculpture 16' is included therein which is contemplated to be of any shape as desired and may be similar to that shown in the embodiment of FIGS. 1–4.

Figure 6:
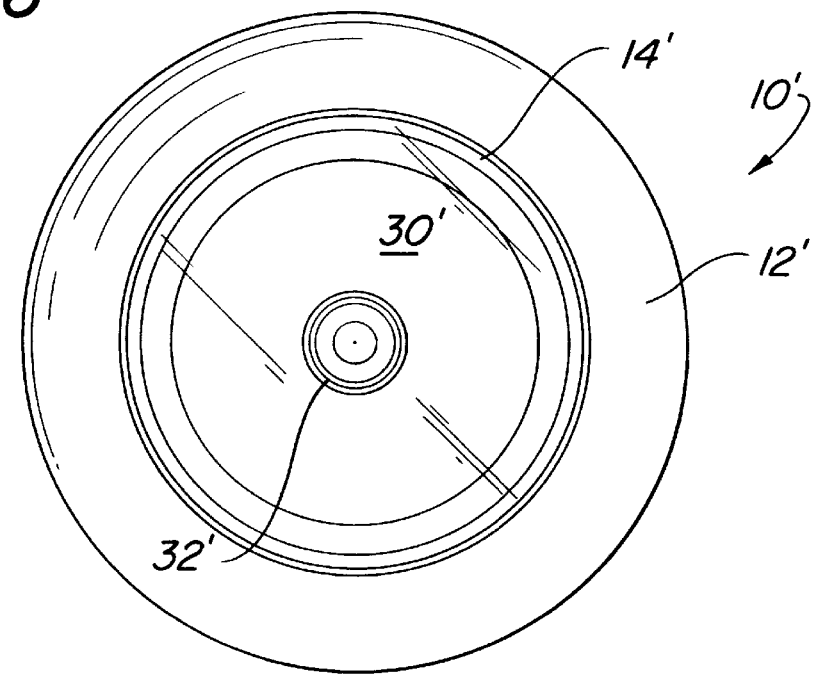
FIG. 6 is a rear elevation of the decorative display embodiment in FIG. 5.
Figure 7:
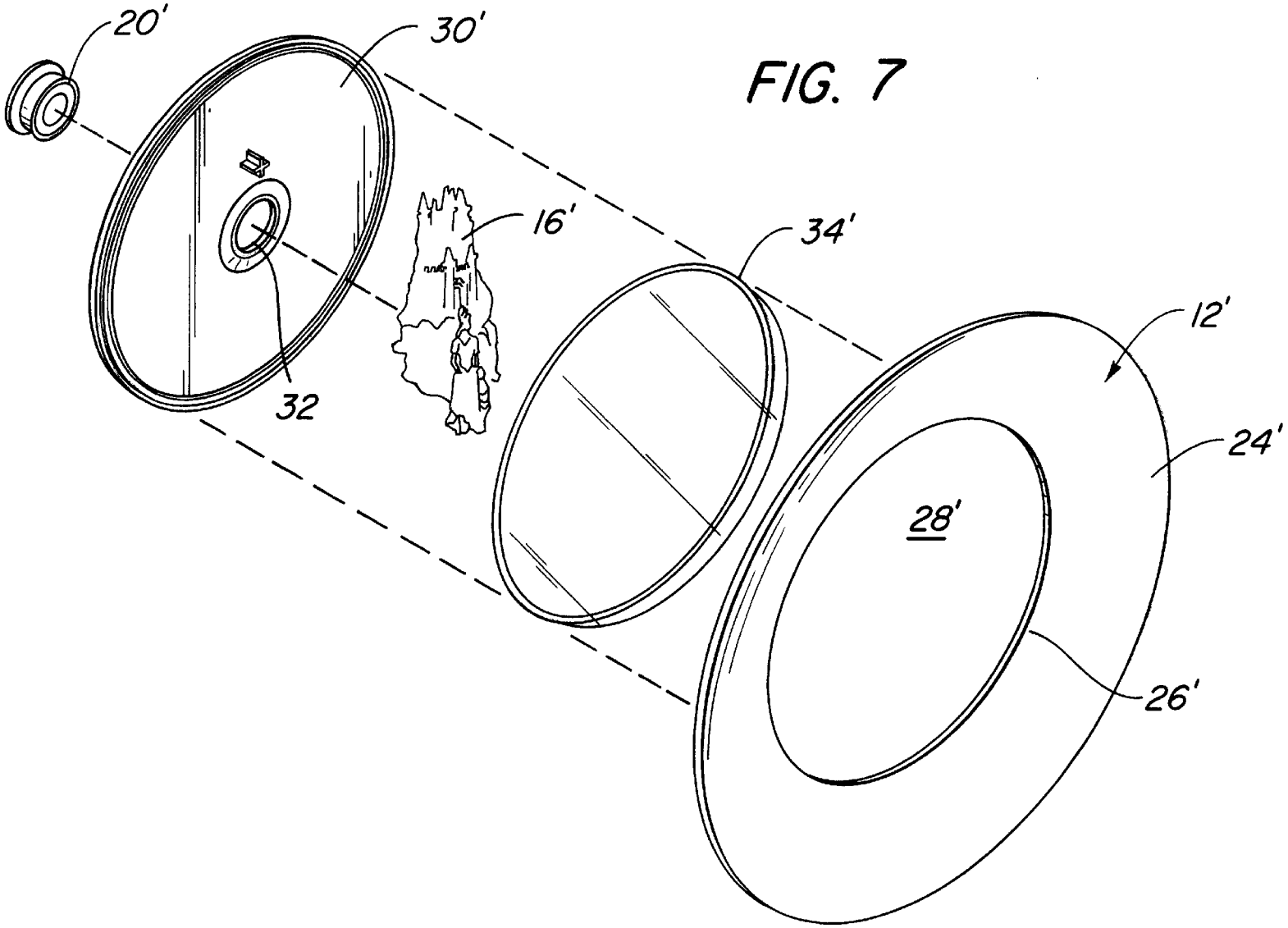
FIG. 7 is an exploded perspective view of the decorative display contemplated by FIGS. 5 and 6.

FIG. 6 shows the alternate embodiment of the display 10' from the rear. The plate 12' is provided with a central opening 28' (FIG. 7). The back wall 30' of the vessel 14' is positioned within the central opening 28 to form the rear surface of the display 10'.

Figure 8:
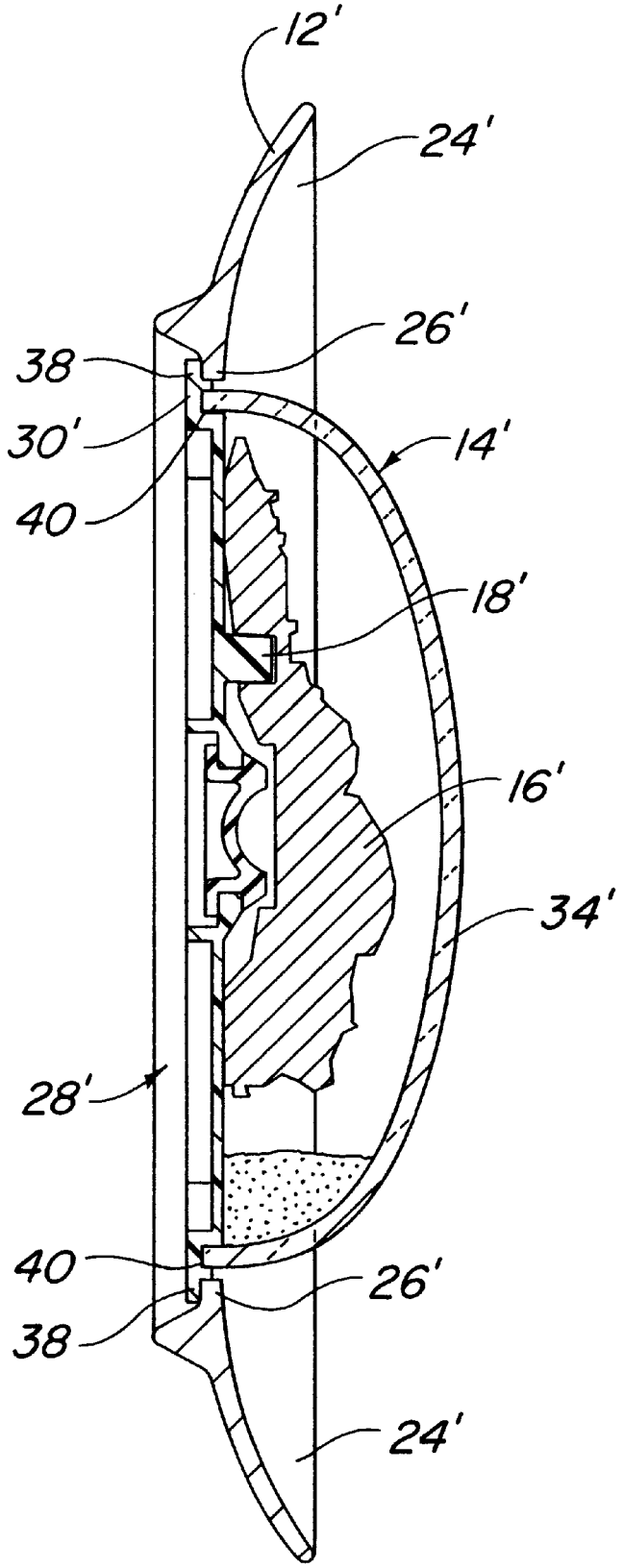
FIG. 8 is a cross sectional view of the decorative display as taken along line 8—8 in FIG. 5.

As more particularly illustrated in FIGS. 7 and 8, the rear wall 30' of the vessel 14' is positioned behind the central opening 28' with the curved lid 34' extending through the opening forward of the plate 12'. The circular lip 26' on the central portion of the plate receives a flange 38 which projects radially outwardly from the back wall 30' of the vessel 14'. The peripheral edge of the curved lid 34' is engaged within a slot 40 on the front surface of the back wall 30'. Again, ultrasonics, heat welding and/or adhesive may be utilized to secure the lid 34 within the slot 40 in the front surface of the back wall 30'. As illustrated in FIGS. 6 and 8, the rear wall 30' is flat so as to accommodate the application of a decal or the like (not shown) having printed indicia thereon. However, a series of radially projecting ribs (not shown) extending outwardly from the central opening 32' may also be provided, if desired, so as to stiffen the rear wall 30'. A plug 20' is positioned within the central opening 32' within the rear wall 30' of the vessel 14'. The annual rim 24' projects outwardly from the central portion. The sculpture 16' is mounted on a projection 18' which is on the front surface of the back wall 30' of the vessel 14'.

It should be noted that a number of variations in the structure of the plate and/or vessel are contemplated. The plate may be other than circular and its rim may be defined at a number of angles, including being planer with the central portion of the plate. In addition, the reservoir vessel may be other than having a curved dome which projects outwardly. Rectangular and/or square openings as well as angular or prismatic surfaces are contemplated. In addition, the sculpture may be varied in any manner desired in order to create a decorative display. The type of sculpture that maybe provided includes (although is not limited to) a figurine or replica of a car, flower, doll, animal, insect, building, etc. Associated artwork may be included on the exposed surface of the back wall of the reservoir which may be meshed with the artwork provided on the plate.

The present invention may be embodied in other specific forms without departing from the spirit or essential attributes thereof and, accordingly, reference should be made to the appended claims, rather than to the foregoing specification, as indicating the scope of the invention.

What is claimed is:

1. A decorative article comprising:

a plate having a substantially planer central portion and a surrounding peripheral rim which is at least partially projected upwardly and outwardly at an acute angle with respect to the planer central portion;

a transparent vessel mounted within the central portion of the plate and projecting from one side of the plate in the same direction as the peripheral rim which also a extends substantially radially outwardly therefrom, the vessel including a rear wall which is fixed to the central portion of the plate and a curved lid which projects from the rear wall and from the central portion of the plate, the vessel defining a reservoir retaining a liquid therein and a particulate material; and a sculpture positioned within the reservoir formed by the vessel and fixed in position proximal to the central portion of the plate.

2. A decorative article as claimed in claim 1 further comprising a removable plug mounted within an opening in the rear wall of the vessel, providing access to the reservoir for filling liquid or particulate material.

3. A decorative article as claimed in claim 1 wherein the central portion of the plate includes a circular lip radially inward of the rim and defining an opening through which the reservoir is exposed.

4. A decorative article as claimed in claim 1 wherein the sculpture is mounted on a projection which is formed integrally with the rear wall of the vessel.

5. A decorative article comprising:

a plate having a central portion and a surrounding peripheral rim, the rim projected upwardly and outwardly at an acute angle with respect to the plane of the central portion;

a transparent vessel mounted on the central portion of the plate with the peripheral rim extending substantially radially outwardly therefrom, the vessel retaining a liquid and a particulate material therein, the vessel including a rear wall and a lid which projects from the rear wall and the plate; and a sculpture positioned within the vessel, the plate having artwork or other indicia thereon conforming to the theme of the sculpture.

6. A decorative display as claimed in claim 5 wherein the lid of the vessel is forms a smooth continuously curved surface.

7. A decorative article as claimed in claim 5 wherein the vessel is positioned within an opening in the central portion of the plate.

8. A decorative article as claimed in claim 5 wherein the vessel is secured to the plate on the front surface thereof by means of a circular lip which is radially inward of the rim of the plate.

9. A decorative article as claimed in claim 5 wherein the vessel is secured to the plate from the rear surface thereof by means of a circular lip which is radially inward of the rim.

10. A decorative article comprising:

a plate having a substantially planer central portion and a surrounding peripheral rim which is at least partially projected upwardly and outwardly at an acute and with respect to the central portion;

a transparent vessel mounted to the central portion of the plate with the peripheral rim extending substantially radially outwardly therefrom, the vessel retaining a liquid substantially filling the vessel, the vessel further retaining a particulate material disbursed within the liquid, the particulate material having a particle size which is visible within the liquid and having a specific gravity heavier than, but close to, the specific gravity of the liquid, the vessel including a rear wall and a lid, the lid projecting from the rear wall and the plate upon being mounted thereto; and a sculpture positioned within the vessel, the plate having artwork or other indicia thereon conforming to the theme of the sculpture.

* * * * *